US006040782A

United States Patent [19]

Banno

[11] Patent Number: 6,040,782

[45] Date of Patent: Mar. 21, 2000

[54] RADIO SIGNAL RECEIVING APPARATUS WITH AUDIO SIGNAL RECEIVING AND REPRODUCING FUNCTION

[75] Inventor: Satoshi Banno, Tokyo, Japan

[73] Assignee: NEC Corporation, Tokyo, Japan

[21] Appl. No.: 08/956,721

[22] Filed: Oct. 23, 1997

[30] Foreign Application Priority Data

Oct. 23, 1996 [JP] Japan ..... 8-280841

[51] Int. Cl.[7] ..... G08B 5/22

[52] U.S. Cl. ..... 340/825.25; 340/825.44

[58] Field of Search ..... 340/825.25, 825.44; 455/45, 38.1, 462; 369/19; 379/88.28

[56] References Cited

U.S. PATENT DOCUMENTS

| | | | |
|---|---|---|---|
| 4,585,903 | 4/1986 | Schiller et al. | 455/462 |
| 4,964,108 | 10/1990 | Ohtsu et al. | 369/19 |
| 5,414,758 | 5/1995 | Kuok | 379/88.28 |

FOREIGN PATENT DOCUMENTS

| | | |
|---|---|---|
| 1-110528 | 7/1989 | Japan . |
| 2-202239 | 8/1990 | Japan . |
| 3-112255 | 5/1991 | Japan . |
| 8-237152 | 9/1996 | Japan . |
| 2 151 380 | 7/1985 | United Kingdom . |
| 2 231 241 | 11/1990 | United Kingdom . |

*Primary Examiner*—Michael Tokar
*Assistant Examiner*—Jean B. Jeanglaude
*Attorney, Agent, or Firm*—Scully, Scott Murphy & Presser

[57] ABSTRACT

In a radio signal receiving apparatus with audio signal receiving and reproducing function, if a message signal is received from an external device when an accompanying sound reproducer is in use, the connection of the sound reproducer to a speaker is required to be disconnected so as to connect the speaker to a radio receiver section which supplies the received message signal. The apparatus is configured such that when a message sent from an external device is inputted to the receiver section during the use of the sound reproducer, the sound reproducer automatically changes a sound volume of a signal therefrom to a prescribed value. In a simultaneous reproducer, an audio signal from the message reproducer is mixed with the audio signal of which the sound volume is changed in the sound reproducer to be supplied to a loudspeaker. The resultant signal is then sounded by the loudspeaker. In this construction, even if an external message sent is fed to the receiver section when the sound reproducer is in operation, the sound of the message signal can be produced without interrupting the output operation of the audio signal from the sound reproducer.

15 Claims, 6 Drawing Sheets

RADIO SIGNAL RECEIVING APPARATUS WITH AUDIO SIGNAL RECEIVING AND REPRODUCING FUNCTION

BACKGROUND OF THE INVENTION

The present invention relates to a radio signal receiving apparatus with audio signal receiving and reproducing function having functions to reproduce voice and sound such as a radio set and/or a cassette deck. More particularly, the invention relates to a radio signal receiving apparatus with audio signal receiving and reproducing function for use with a selective calling pager having a sound reproducing function for automatically reproducing a message received by the selective calling pager.

DESCRIPTION OF THE RELATED ART

FIG. 1 shows in a block diagram an example of constitution of a conventional radio signal receiving apparatus with audio signal receiving and reproducing functions.

The conventional example shown in FIG. 1 includes an accompanying sound reproducer 22 including a radio set, a cassette recorder, or the like for reproducing sound and voice, a radio signal reception switching device 27 for receiving a message signal transmitted from an external device and outputting the received signal and a voice signal from the sound reproducer 22 by conducting a change-over or switching operation between these signals, and a loudspeaker 24 receiving the audio signal from the radio signal reception switching device 27 and producing voice and sound associated with the received signal. The radio signal reception switching device 27 includes a signal receiving antenna 20 for receiving a message signal sent from an external facility, a radio signal receiving section 21 for converting the message signal supplied via the antenna 20 into an audio signal, a switching relay 25 having an open-contact point 25*a* and a closed-contact point 25*d* for conducting a change-over operation between the audio signal from the receiving section 21 and that from the sound reproducer 22, and a delay section 26 for delaying a prescribed period of time the audio signal from the receiving section 21 and supplying the delayed signal to the relay 25 (reference to be made to the Japanese Patent Application Laid-Open No. HEI 2-202239).

Description now be given of operation of the radio signal receiving apparatus with audio signal receiving and reproducing function configured as above.

First, a message signal sent from an external device is received via the antenna 20 to be sent to the receiver 21. The signal is converted into an audio signal and is then outputted therefrom.

The audio signal from the receiver 21 is fed via the delay section 26 to the relay circuit 25 such that the open-contact point 25*a* and the closed-contact point 25*b* are excited to be set to open and closed states, respectively.

Resultantly, the receiver 21 is connected to the speaker 24, whereas the sound reproducer 22 is disconnected from the speaker 24.

Moreover, the message signal received via the antenna 20 is supplied as an audio signal to the speaker 24. The signal is outputted as voice and/or sound from the speaker 24.

After the radio communication from the external device is terminated, if any message is received via the antenna 20 and any audio signal is supplied via the delay section 26 to the relay 25 within at least a prescribed period of time, the point 25*a* and 25*b* are respectively restored to the original states in the relay 25. Namely, the receiver 21 is disconnected from the speaker 24 and the sound reproducer 22 is again coupled with the speaker 24 such that the audio signal from the reproducer 22 is sounded by the speaker 24.

In the conventional radio signal receiving apparatus with audio signal receiving and reproducing function described above, when a message signal is received from an external device in a state in which the accompanying sound reproducer is in operation, the reproducer in use is required to be disconnected from the speaker so that the radio receiver which outputs the received message is linked with the speaker.

However, when the connection or disconnection is to be manually switched, the operator is required to manually change the state of connection or disconnection. For example, when the user is driving a car, this may result in a fear of an accident.

Moreover, even when the change of connection or disconnections automatically carried out, the sound from the reproducer in use is abruptly interrupted, which may possibly be uncomfortable for the user in some cases.

SUMMARY OF THE INVENTION

It is therefore an object of the present invention, which has been devised to remove the problem of the prior art, to provide a radio signal receiving apparatus with audio signal receiving and reproducing function in which when a message signal is received during the operation of the accompanying sound reproducer, the received message can be outputted without interrupting the sound signal from the reproducer.

In accordance with one aspect of the present invention, there is provided a radio signal receiving apparatus with audio signal receiving and reproducing function including a receiver section for receiving a message signal sent from external device, converting the message signal into an audio signal, and outputting the audio signal therefrom; a message reproducer circuit for conducting a reproducing operation for the audio signal from the receiver section and outputting therefrom an audio signal thus reproduced, an accompanying sound reproducer circuit for conducting a reproducing operation for an audio signal fed from an accompanying sound reproducer and outputting therefrom an audio signal reproduced through the operation, output means for receiving the audio signals respectively from the message reproducer circuit and the accompanying sound reproducer circuit and outputting (sounding) the audio signals therefrom, and a simultaneous producer section for mixing the audio signal from the message reproducer circuit with that from the accompanying sound reproducer circuit and delivering a signal resultant from the mixing operation to the output means. In the apparatus, the accompanying sound reproducer circuit automatically changes, when the message signal is inputted to the receiver section, a sound volume of the audio signal therefrom to a predetermined value.

In accordance with an another aspect of the present invention, the accompanying sound reproducer circuit automatically restores, when the message signal is completely outputted (sounded) by the output means, the sound volume of the audio signal to the original value before the change thereof.

In accordance with an another aspect of the present invention, the accompanying sound reproducer circuit changes the sound volume in a continuous and stepless manner.

In accordance with an another aspect of the present invention, the radio signal receiving apparatus with audio signal receiving and reproducing function further includes a storage section for storing therein the audio signal fed from the receiver section and an automatic reproduction control section for controlling, when the message signal is delivered to the receiver section, whether or not the output means outputs (sound) the message signal.

In accordance with an another aspect of the present invention, the radio signal receiving apparatus with audio signal receiving and reproducing function further includes a reporting section for outputting, when the audio signal is outputted from the receiver section, a signal indicating an event that the message signal is inputted to the receiver section.

In accordance with an another aspect of the present invention, the accompanying sound reproducer is a radio set.

In accordance with an another aspect of the present invention, the accompanying sound reproducer is a cassette desk.

In accordance with an another aspect of the present invention, the accompanying sound reproducer includes a radio set and a cassette deck and the apparatus further includes selector means for selecting the radio set or the cassette deck, selected one of the radio set or the cassette deck outputting an audio signal to the accompanying sound reproducer circuit.

In accordance with an another aspect of the present invention, the output means is a loudspeaker.

In accordance with the present invention providing the configuration above, when a message signal from an external device is received by the receiving section during the operation of the accompanying sound reproducer, the sound volume of the sound or audio signal from the sound reproducer is automatically changed to a predetermined value. In the simultaneous reproducer, the audio signal from the message reproducer is mixed with the audio signal having the adjusted sound volume to be fed to the output means such that the mixed signal is sounded by the output means.

Thereafter, when the output means completely sounds the message signal, the sound volume of the audio signal from the sound reproducer is automatically restored to the original value and only the audio signal from the sound reproducer is sounded by the output means.

As above, in a case in which a message signal from an external device is received by the receiving section during the operation of the accompanying sound reproducer, the sound volume of the audio signal from the sound reproducer is changed such that the sound of the message signal is clearly produced by the output means. Therefore, even when the sound of the message signal is produced, it is unnecessary to stop the output of sound from the sound reproducer.

Additionally, when there are disposed a storage section to store therein the audio signal from the receiving section and an automatic reproduction controller to determine, when a message signal is inputted to the receiving section, whether or not the message signal is sounded by the output means, a confidential message and a message which need not heard at reception thereof can be stored in the storage to be reproduced later.

The above and further objects and novel features of the invention will be more fully understood from the following detailed description when the same is read in connection with the accompanying drawings. It should be expressly understood, however, that the drawings are for purpose of illustration only and are not intended as a definition of the limits of the invention.

DETAILED DESCRIPTION OF THE PREFERRED EMBODIMENTS

A preferred embodiment of the invention will now be described in detail referring to the accompanying drawings.

A radio signal receiving apparatus with audio signal receiving and reproducing function according to the invention has a function to reproduce voice and sound such as a radio set and/or a cassette deck, and in particular, to a wireless receiver for use with a selective calling pager having a sound reproducing function for automatically reproducing a message received by a selective calling pager. When the user utilizes the function to reproduce voice or sound such as a radio set and/or a cassette deck, a pager receiving section receives voice message, it causes sound volume of the radio set and/or the cassette deck to mute, simultaneously it causes the voice message received by the pager receiving section to reproduce.

Figure 1:
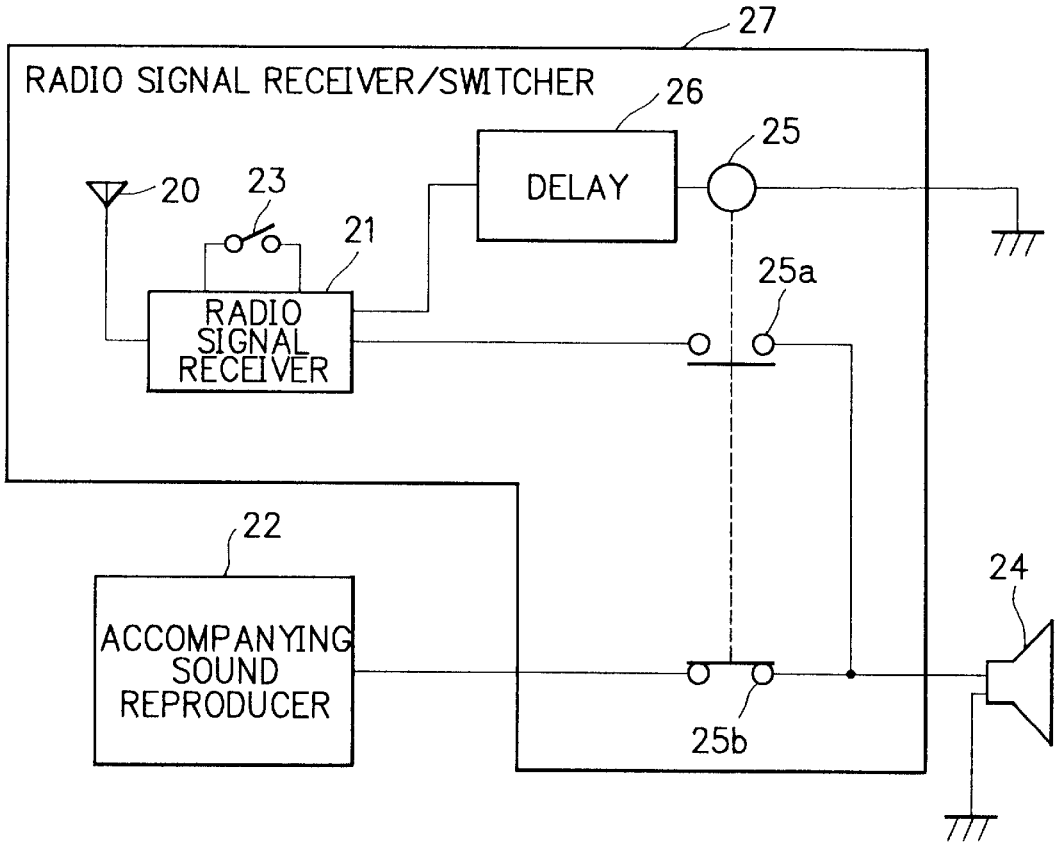
FIG. 1 PRIOR ART
FIG. 1 is a block diagram showing an example of structure of the conventional audio signal receiving and reproducing wireless apparatus.
Figure 2:
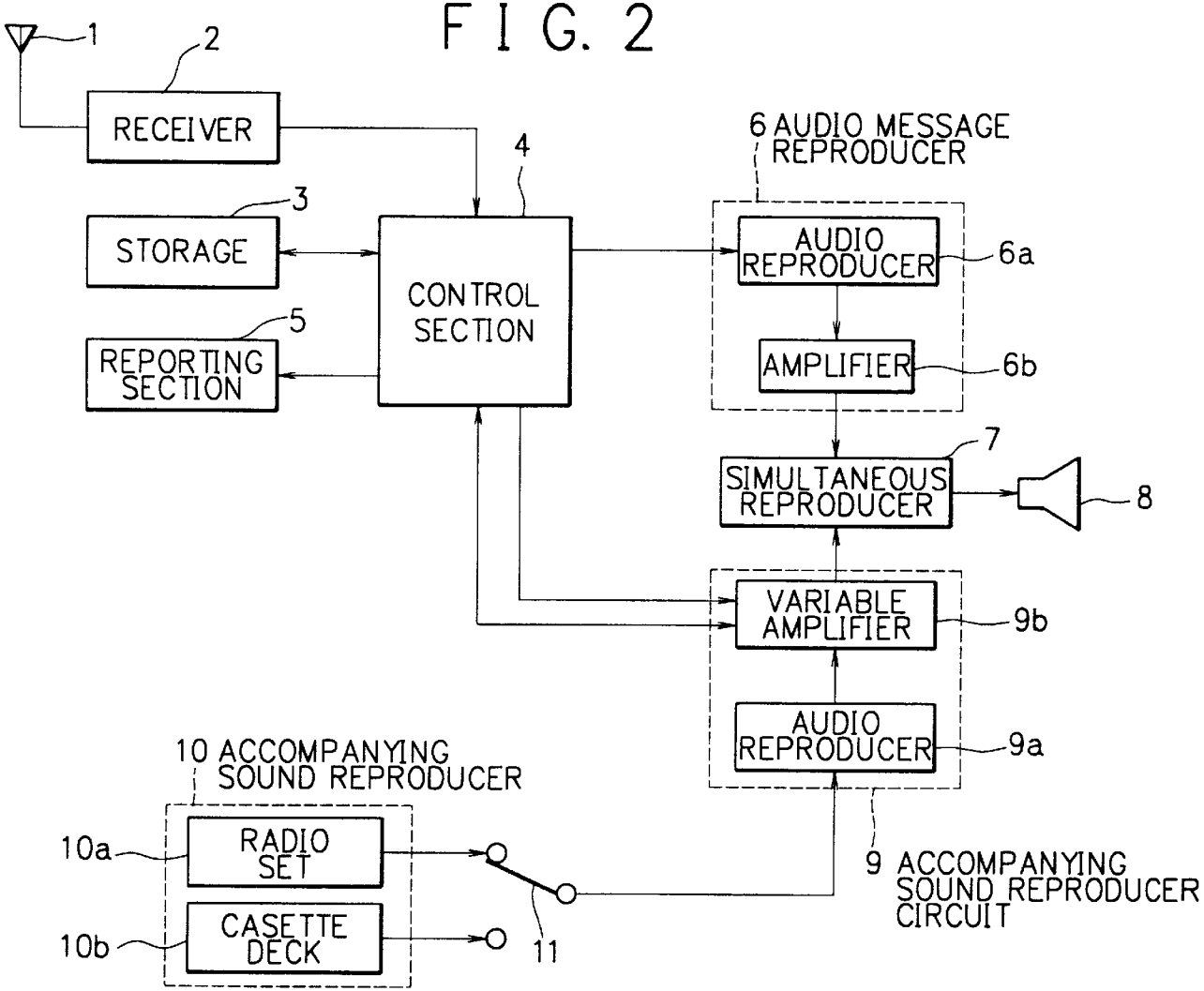
FIG. 2 is a block diagram showing a preferable embodiment of the audio signal receiving and reproducing wireless apparatus in accordance with the present invention.

FIG. 2 shows in a block diagram an embodiment of a radio signal receiving apparatus with audio signal receiving and reproducing function in accordance with the present invention.

As can be seen from FIG. 2, the embodiment is a system on which an accompanying sound reproducer 10 including a radio set 10*a* and a cassette deck 10*b* is to be mounted. The embodiment includes a signal receiving antenna 1 to receive a message signal sent from an external facility, a receiver section 2 to convert the message signal received via the antenna 1 into an audio signal so as to supply the audio signal to a subsequent device, a storage section 3 to store therein the audio signal from the receiver section 2, a reporting section 5 to notify, when the audio signal is sent from the receiver section 2, the reception of the message to the external facility, an audio message reproducer circuit 6 to reproduce the message signal from the audio signal received from the receiver section 2, an accompanying sound reproducer circuit 9 to reproduce an audio signal from the accompanying sound signal sent from the accompanying sound reproducer 10, a simultaneous reproducer 7 to mix the audio signals respectively from the audio message reproducer 6 and the sound reproducer 10 with each other, a loudspeaker 8 as output means to sound the audio signal produced from the simultaneous reproducer 7, and a control section 4 to control operation of the storage 3, the reporting section 5, the audio message reproducer 6, and the accompanying sound reproducer circuit 9. The control section 4 comprises a CPU, an internal memory, and CG and so forth. The audio message reproducer 6 includes an audio reproducer 6*a* to conduct a reproducing operation for an audio signal sent from the receiver 2 and an amplifier 6*b* to amplify an audio signal resultant from the reproduction by the audio reproducer 6*a*. Moreover, the accompanying sound reproducer circuit 9 includes an audio reproducer 9*a* to conduct a reproducing operation for an audio signal outputted from the accompanying sound reproducer 10 and a variable amplifier 9*b* to amplify an audio signal thus reproduced by the audio reproducer 9*a* according to an amplification factor under control of the control section 4. Additionally arranged as selection means is a change-over switch 11 between the reproducer 10 and the reproducer circuit 9 to conduct a change-over operation for the audio signal to be inputted to the reproducer circuit 9.

Figure 3:
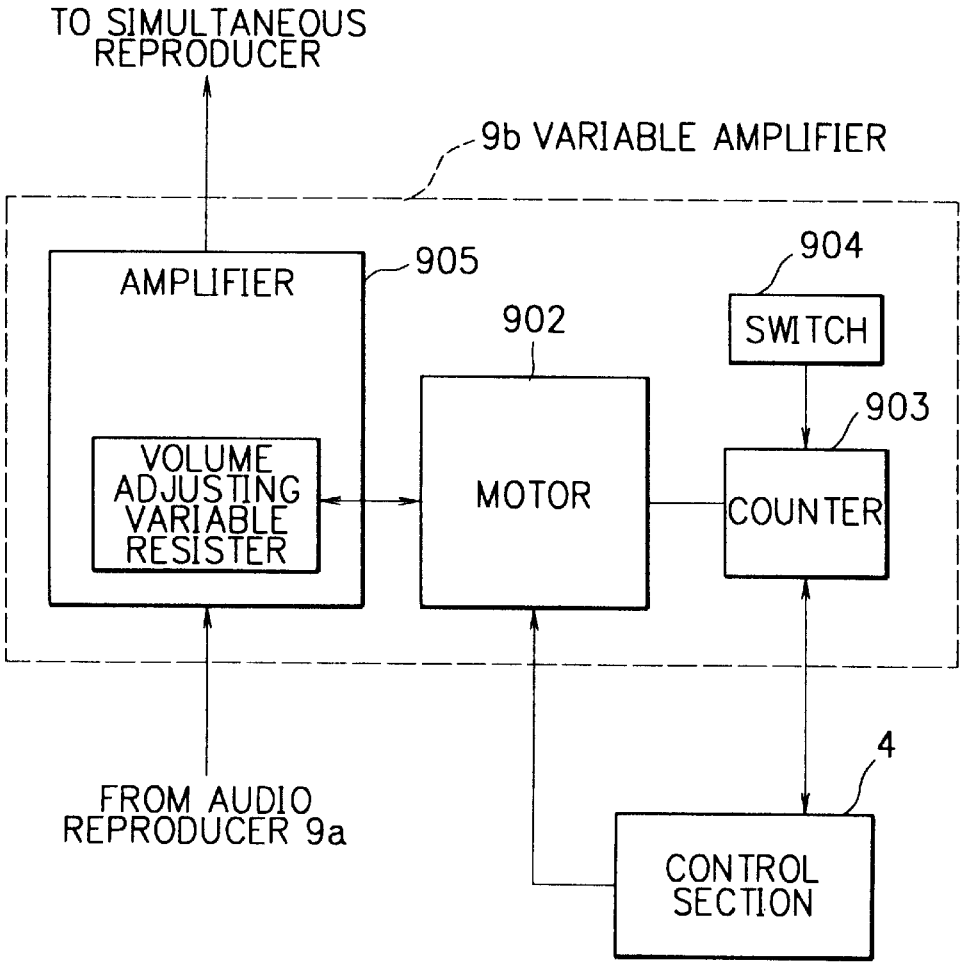
FIG. 3 is a block diagram showing in detail the configuration of a variable amplifier shown in FIG. 2.

FIG. 3 is a detailed block diagram of the configuration of the variable amplifier 9*b* shown in FIG. 2.

As shown in FIG. 3, the amplifier 9*b* of the embodiment includes a switch 904 to set a value to mute or lower the sound volume, an amplifier section 905 to amplify the audio signal from the audio reproducer 9*a*, a motor 902 of which the number of rotations per unitary period of time is determined by the control section 4 and which controls an amplification factor of the amplifier 905, and a counter 903 to count the number of rotations of the motor 902. The amplifier 905 includes a volume adjusting variable resistor 901 to adjust the amplification factor.

Description will now be given of operation of the radio signal receiving apparatus with audio signal receiving and reproducing function constructed as above.

Figure 4:
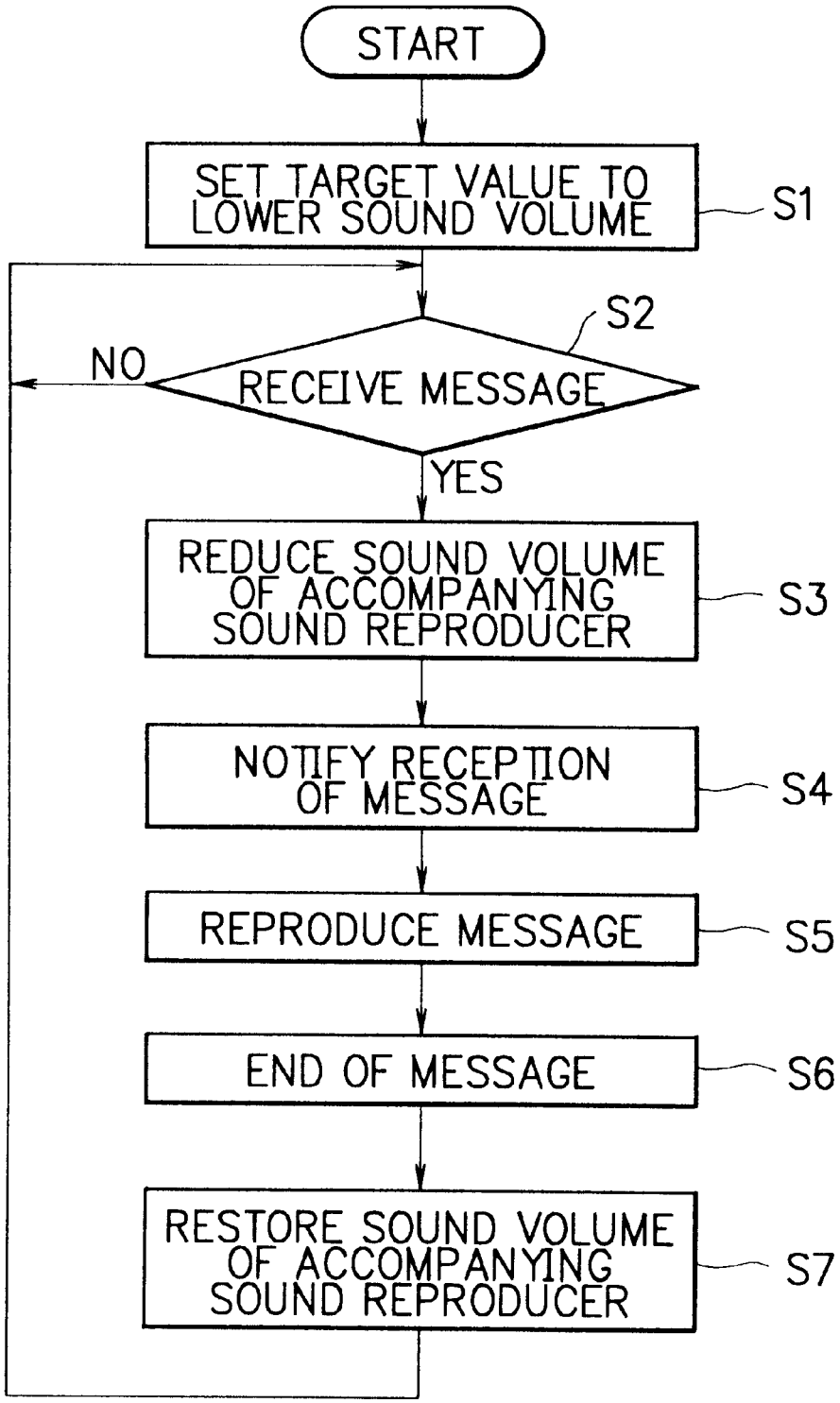
FIG. 4 is a flowchaart for explaining operation of the radio signal receiving apparatus with audio signal receiving and reproducing function shown in FIGS. 2 and 3.

FIG. 4 is a flowchaart for explaining operation of the radio signal receiving apparatus with audio signal receiving and reproducing function shown in FIGS. 2 and 3.

In the embodiment, if an external message signal is received via the antenna 1 when the accompanying sound reproducer 10 is in use, the volume of the audio signal outputted from the sound reproducer 10 is set to prescribed value (to be referred to as a muted volume herebelow) such that the sound from the reproducer 10 and the message set from the external device are outputted (sounded) at the same time. The muted volume is to be set to the apparatus in advance. The prescribed value corresponds to "0" of the counter value of the variable amplifier 9*b* (since the muted sound volume is set by making the counter-value zero). Therefore, under normal condition, the sound volume of the voice which is outputted from the accompanying sound reproducer 10 in cases where the message signal is received from the outside is the sound volume of the counter-value "0", while the sound volume of voice outputted from the accompanying sound reproducer 10 is arbitrarily changed by adjusting the volume adjusting variable resistor by the user. At this time when the counter-value is positive number such as 10, or 20, the sound volume is bigger than the muted sound value, while when the counter-value is negative number such as −10, or −20, the sound volume is smaller than the muted sound value.

First, when the user lowers the volume of the reproducer circuit 9 to the muted volume and then pushes the switch 904, the muted volume is set to the apparatus (step 1). In this operation, the value of the counter 903 is reset to zero.

Once the muted volume is set as above, the volume of the reproducer circuit 9 can be arbitrarily altered and the audio signal from the reproducer 10 is sounded by the loudspeaker 8.

In the situation above, when the message signal from the external facility is received via the antenna 1 (step 2), the received signal is transformed through the receiver section 2 into an audio signal to be stored in the storage 3 under supervision of the control section 4. Furthermore, the amplification factor of the variable amplifier 9*b* is also controlled such that the sound volume of the signal from the reproducer circuit 9 is set to the muted volume (step 3).

Next, description will be given in detail of the operation to control the amplification factor of the variable amplifier 9*b*.

After the muted volume is set to the apparatus, when the sound volume of the reproducer 10 is changed from the muted volume, the motor 902 rotates in association with the change in the sound volume and the count value of the counter 903 is accordingly varied. In this regard, assume that the direction of rotation of the motor 902 to increase the sound volume relative to the muted volume is called "positive direction of rotation" and the counting operation of the counter 903 is referred to as "positive counting (addition)". For the decreasing operation of the sound volume, the direction is called "negative direction of rotation" and the counting operation is referred to as "negative counting (subtraction)". When the counter-value of the counter 903 is set a positive value, the sound volume is related to a position advanced relative to the position of the muted volume according to the counter-value. Conversely, when the counter-value is a negative value, the sound volume is associated with a position lowered relative to the position of the muted volume in accordance with the counter-value. Namely, since the value of the counter 903 is set to zero at the time of setting of the muted sound volume, in every increasing the sound volume from the position of zero, the value of the counter 903 is counted in the positive direction such as 1, 2, 3, . . . , while in every decreasing the sound volume from the position of zero, the value of the counter 903 is counted in the negative direction such as −1, −2, −3, . . . inversely.

A base band signal (voice message) is decoded at the receiving section 2 to be restored in the storage 3. When the audio message is reproduced, it causes counter-value of the present sound volume to store to the internal memory of the control section 4 temporally. Next, the control section 4 sends a control signal to the rotational motor such that it causes the rotational motor to rotate in the direction that the sound volume of the accompanying sound reproducer becomes zero of counter-value. When the counter-value becomes zero, the control section sends a control signal stopping the motor. After termination of reproducing the message, the control section sends a signal to the rotational motor such that it causes the rotational motor to rotate in the direction that the sound volume of the accompanying sound reproducer becomes the former counter value stored in the internal memory to be returned to the former sound value.

When the audio signal from the receiver section 2 is fed to the cotrol section 4, the value of the counter 903 at the moment is temporarily stored in the control section 4 such that the motor 902 rotates to set the counter 903 to zero. Accordingly, the value of resistance of the variable resistor 901 is controlled in a continuous or stepless manner such that the sound volume of the audio signal from the amplifier 9*b* is set to the muted volume. The stepless manner is a manner to realize smooth change of the sound volume such that it causes the resistance value to change continuously instead of change at one time.

When the muted volume is accordingly set as above, an event of reception of the message signal via the antenna 1 is notified by the reporting section 5, namely, the notification is achieved by a light beam to the user or vibration is imparted to the user (step 4).

Subsequently, in the cotrol section 4, the audio signal is read from the storage 3 to be sent to the audio message reproducer circuit 6. The signal is subjected to reproducing and amplifying operations therein to be fed to the simultaneous reproducer 7.

On the other hand, the audio signal inputted to the reproducer circuit 9 from the accompanying sound reproducer 10 is outputted therefrom as audio signal having the muted volume and is then fed to the simultaneous reproducer 7.

When the audio signals are supplied from the audio message reproducer 6 and the accompanying sound reproducer circuit 9 to the simultaneous reproducer 7, these signals are mixed with each other therein to be sound from the loudspeaker 8 (step 5). Namely, the message from the external device and the sound which is fed from the accompanying sound reproducer 10 and of which the sound volume is adjusted to the muted volume are sounded by the loudspeaker 8.

After this point, when the audio message from the external facility is completed (step 6), the sound volume of the audio signal from the reproducer circuit 9 is restored by the control section 4 to the original volume, i.e., the volume before the reduction thereof to the muted volume (step 7). The completion of output of the audio message may be decided such that a sign which indicates the last of the message is attached to the last of the message, or maximum value of the audio message is determined formerly, for example when the information is 20 sec-MAX, the audio message is completed after 20 sec past. In the operation above, the position related to the sound volume from the reproducer circuit 9 and the position before the volume is lowered to the muted volume are restored under control of the control section 4, the positions being respectively memorized as counter-values of the counter 903 of the variable amplifier 9*b*. Consequently, it is only necessary to reverse the operation to minimize the volume to the muted volume. That is, the motor 902 is reversely rotated to set the counter-value 903 from 0 to the stored original value so as to automatically restore the sound volume.

Description will now be given of another embodiment in accordance with the present invention.

Figure 5:
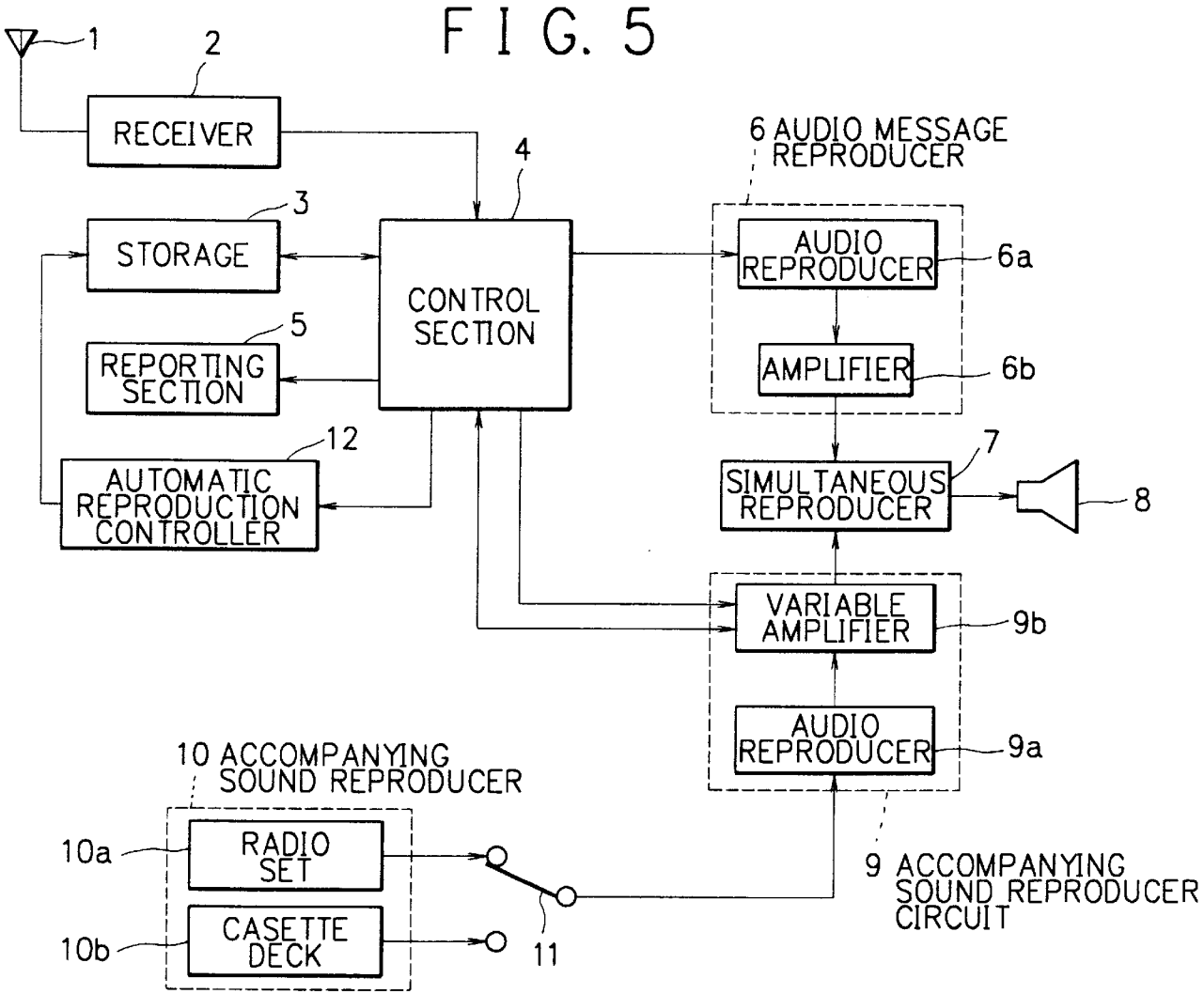
FIG. 5 is a block diagram showing another embodiment of the radio signal receiving apparatus with audio signal receiving and reproducing function in accordance with the present invention.
Figure 6:
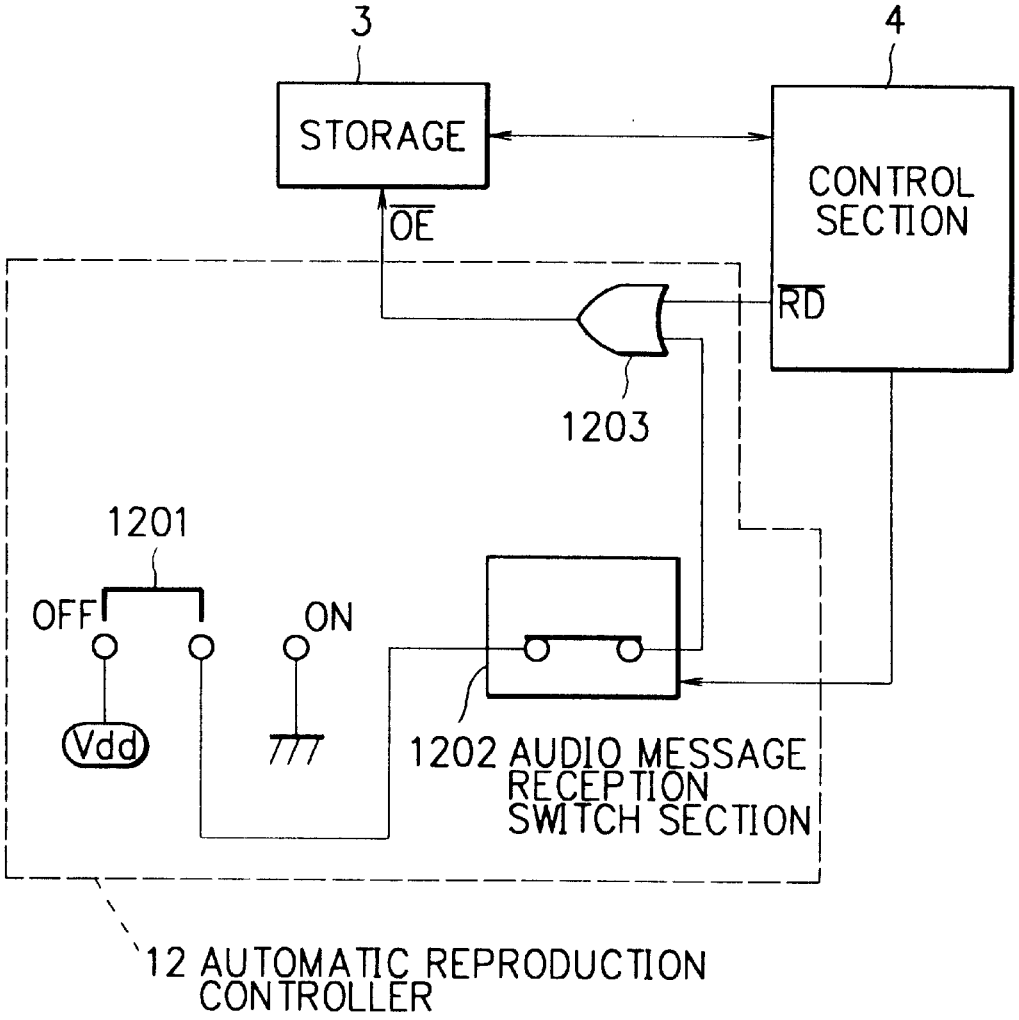
FIG. 6 is a block diagram showing in detail the construction of an automatic reproduction controller shown in FIG. 5.

FIG. 5 shows in a block diagram of another embodiment of the radio signal receiving apparatus with audio signal receiving and reproducing function in accordance with the present invention and FIG. 6 is a block diagram showing in detail the configuration of an automatic reproduction controller 12 of FIG. 5.

The embodiment includes, in addition to the configuration shown in FIG. 2, an automatic reproduction controller 12 to control the automatic reproduction of the message signal received via the antenna 1 as shown in FIGS. 5 and 6. The controller 12 includes an automatic reproduction selector switch 1201 to select whether or not the automatic reproduction is conducted for the message signal received via the antenna 1, an audio message reception switch section 1202 which is set to the on state only when a message signal is received from an external device, and an OR gate 1203. The OR gate 1203 includes a first input terminal connected to an (Read Strobe) RDB terminal of the control section 4, a second input terminal linked with a first terminal of the switch 1201 via the switch section 1202, and an output terminal coupled with an (Output Enable) OEB terminal of the storage 3. The selector switch 1201 has a second terminal connected to Vdd or GND depending on the operation of the selector switch 1201.

Next, description will be given of operation of the wireless apparatus constructed as above. In this regard, any operation already described for the wireless apparatus shown in FIGS. 2 and 3 will be avoided for simplification of explanation.

When the automatic reproduction is accomplished for the message signal sent from an external device, the selector switch 1201 is set to the on state in advance. In this state, the second terminal of the switch 1201 is connected to GND.

In this state, when a message signal is received from an external facility, the switch section 1202 is turned on and a low-level signal is delivered to the second input terminal of the OR gate 1203.

In response to reception of the external message signal, to read the audio signal from the storage 3, a low-level signal is outputted from the RDB terminal of the control section 4 to be fed to the first input terminal of the OR gate 1203.

Resultantly, a low-level signal is supplied from the OR gate 1203 to the OEB terminal of the storage 3 such that the audio signal is read from the storage 3 to be subjected to the automatic reproduction.

When the automatic reproduction is not required to be conducted for the external message signal, the switch 1201 is set to the off state. In this state, the second terminal of the switch 1201 is coupled with Vdd.

When a message signal is received from an external device under this condition, the switch section 1202 is turned on such that a high-level signal is fed to the second input terminal of the OR gate 1203.

As a result, a high-level signal is sent from the OR gate 1203 to the OEB terminal of the storage 3. Namely, the audio signal is not read from the storage 3 and the automatic reproduction of the signal is not achieved.

Thanks to the configuration of the present invention described above, there are obtained the following advantages.

In the construction associated with the present invention, if a message signal is inputted from an external device to the receiver section when the accompanying sound reproducer is in use, the sound volume of the sound reproducer is automatically changed to a prescribed value in the sound reproducer. In the simultaneous reproducer, the audio signal from the message reproducer is mixed with the audio signal from the sound reproducer having the changed sound volume such that the resultant signal is sounded by output means. Consequently, even when the external message is received by the receiver section during the operation of the sound reproducer, the message signal can be reproduced without interrupting the output of the sound reproducer.

In the configuration described in the invention, the sound volume can be changed in a continuous and stepless manner. Therefore, the sound volume is smoothly altered in the change of sound volume. This avoids the uncomfortable abrupt change in the sound volume.

According to an aspect of the configuration of the invention, there are disposed a storage section to store therein the audio signal sent from the receiver section and an automatic reproduction controller to control the operation to sound the message signal from output means. Consequently, a confidential message and any message not required to be reproduced at the reception thereof can be stored in the storage section to be reproduced later.

In accordance with an aspect of the invention, there is provided a reporting section to output, when the audio signal is outputted from the receiver section, a signal indicating the reception of a message signal by the receiver section. Therefore, even when the message signal is not sounded from the output means under supervision of the automatic reproduction controller, the reception of the message signal can be recognized in a real time fashion.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. A radio signal receiving apparatus with audio signal receiving and reproducing function, comprising:

a receiver section for receiving a message signal sent from an external device, converting said message signal into an audio signal, and outputting said audio signal therefrom;

a message reproducer circuit for conducting a reproducing operation for said audio signal from said receiver section and outputting therefrom an audio signal thus reproduced;

an accompanying sound reproducer circuit for conducting a reproducing operation for an audio signal fed from an accompanying sound reproducer and outputting therefrom an audio signal reproduced through the operation;

output means for receiving said audio signals respectively from said message reproducer circuit and said accompanying sound reproducer circuit and outputting audio sound corresponding to said audio signals; and a simultaneous producer section for mixing said audio signal from said message reproducer circuit with said audio signal from said accompanying sound reproducer circuit and delivering a signal resultant from the mixing operation to said output means, the accompanying sound reproducer circuit automatically changing, when said message signal is inputted to said receiver section, a sound volume of said audio signal to a prescribed sound volume value.

2. A radio signal receiving apparatus with audio signal receiving and reproducing function according to claim 1, wherein said accompanying sound reproducer circuit automatically restores, when said message signal is completely outputted (sounded) by said output means, said sound volume of said audio signal to the original value before the change thereof.

3. A radio signal receiving apparatus with audio signal receiving and reproducing function according to claim 1, wherein said accompanying sound reproducer circuit changes said sound volume in a continuous and stepless manner.

4. A radio signal receiving apparatus with audio signal receiving and reproducing function according to claim 3, further comprising:

a storage section for storing therein said audio signal fed from said receiver section; and an automatic reproduction control section for controlling, when said message signal is delivered to said receiver section, whether or not said output means outputs said message signal.

5. A radio signal receiving apparatus with audio signal receiving and reproducing function according to claim 4, further comprising a reporting section for outputting, when said audio signal is outputted from said receiver section, a signal indicating an event that said message signal is inputted to said receiver section.

6. A radio signal receiving apparatus with audio signal receiving and reproducing function according to claim 5, wherein said accompanying sound reproducer is a radio set.

7. A radio signal receiving apparatus with audio signal receiving and reproducing function according to claim 5, wherein said accompanying sound reproducer is a cassette deck.

8. A radio signal receiving apparatus with audio signal receiving and reproducing function according to claim 5, wherein said accompanying sound reproducer includes a radio set and a cassette deck, the apparatus further comprising selector means for selecting said radio set or said cassette deck, selected one of said radio set or said cassette deck outputting an audio signal to said accompanying sound reproducer circuit.

9. A radio signal receiving apparatus with audio signal receiving and reproducing function according to claim 5, wherein said output means is a loudspeaker.

10. Receiving and reproducing method of a radio signal receiving apparatus with audio signal receiving and reproducing function comprising the steps of:

receiving a message signal sent from an external device, converting said message signal into an audio signal, and outputting said audio signal from a receiver section;

conducting a reproducing operation for said audio signal from said receiver section and outputting therefrom an audio signal thus reproduced by a message reproducer circuit;

conducting a reproducing operation for an audio signal fed from an accompanying sound reproducer and outputting therefrom an audio signal reproduced through the operation by an accompanying sound reproducer circuit;

receiving said audio signals respectively from said message reproducer circuit and said accompanying sound reproducer circuit and outputting audio sound corresponding to said audio signals by output means; and mixing said audio signal from said message reproducer circuit with said audio signal from said accompanying sound reproducer circuit and delivering a signal resultant from the mixing operation to the output means by a simultaneous producer section, the accompanying sound reproducer circuit automatically changing, when said message signal is inputted to said receiver section, a sound volume of said audio signal to a prescribed sound volume value.

11. Receiving and reproducing method of a radio signal receiving apparatus with audio signal receiving and reproducing function according to claim 10, wherein receiving and reproducing method of the accompanying sound reproducer circuit comprises the step of:

restoring automatically, when said message signal is completely outputted by said output means, said sound volume of said audio signal to said original value before the change thereof.

12. Receiving and reproducing method of an audio signal receiving and reproducing apparatus according to claim 10, wherein receiving and reproducing method of the accompanying sound reproducer circuit comprises the step of:

changing said sound volume in a continuous and stepless manner.

13. Receiving and reproducing method of an audio signal receiving and reproducing apparatus according to claim 10, further comprising the steps of:

storing said audio signal fed from said receiver section in a storage section; and controlling, when said message signal is delivered to said receiver section, whether or not said output means outputs (sounds) said message signal by an automatic reproduction control section.

14. Receiving and reproducing method of an audio signal receiving and reproducing apparatus according to claim 13, further comprising the step of:

outputting, when said audio signal is outputted from said receiver section, a signal indicating an event that said message signal is inputted to said receiver section by a reporting section.

15. Receiving and reproducing method of an audio signal receiving and reproducing apparatus according to claim 14, further comprising the steps of:

selecting said radio set or said cassette deck, selected one of said radio set or said cassette deck by a selector means; and outputting an audio signal to said accompanying sound reproducer circuit, when said accompanying sound reproducer includes a radio set and a cassette deck.

* * * * *